US008536475B2

(12) United States Patent
Washburn et al.

(10) Patent No.: US 8,536,475 B2
(45) Date of Patent: Sep. 17, 2013

(54) INTEGRATED EN-STYLE AUXILIARY BARRIER CONNECTOR

(75) Inventors: Keith Richard Washburn, Natick, MA (US); Stephen J. Bryant, Coventry, RI (US); William John Bentley, North Dartmouth, MA (US)

(73) Assignee: Sensata Technologies Massachusetts, Inc., Attleboro, MA (US)

( * ) Notice: Subject to any disclaimer, the term of this patent is extended or adjusted under 35 U.S.C. 154(b) by 99 days.

(21) Appl. No.: 13/325,893

(22) Filed: Dec. 14, 2011

(65) Prior Publication Data

US 2013/0153379 A1 Jun. 20, 2013

(51) Int. Cl.
*H01H 1/64* (2006.01)

(52) U.S. Cl.
USPC ..... 200/293

(58) Field of Classification Search
USPC ..... 200/293, 296, 297, 5 R, 5 B, 5 C, 200/6 R, 19.18, 19.2, 19.22, 19.27, 19.3, 200/49, 553, 558, 339
See application file for complete search history.

(56) References Cited

U.S. PATENT DOCUMENTS 3,299,244 A * 1/1967 Strobel et al. ..... 200/5 R
3,463,967 A * 8/1969 Klein ..... 361/634
5,313,033 A * 5/1994 Link et al. ..... 200/401
7,210,970 B1 5/2007 Pellon et al.
2008/0087535 A1* 4/2008 Rakus et al. ..... 200/558

FOREIGN PATENT DOCUMENTS

DE 202010004061 U1 6/2010
WO 9738471 A1 10/1997

OTHER PUBLICATIONS

Extended European Search Report dated Mar. 19, 2013 in corresponding application EP 12193706.4.

* cited by examiner

*Primary Examiner* — Edwin A. Leon
(74) *Attorney, Agent, or Firm* — Chapin IP Law, LLC

(57) ABSTRACT

Techniques disclosed herein include a conversion technique that converts an aircraft circuit breaker having male auxiliary connectors (micro switch connectors) to an aircraft circuit breaker having female auxiliary connectors, such as those conventionally used on European-made aircraft. Techniques include adding a barrier to a conventional aircraft circuit breaker approved for U.S. markets. This barrier includes female auxiliary connectors integrated with the barrier, as well as a flexible circuit that connects the male connectors with the female connectors such that the female connectors can still receive separate male connectors in the female receptacles. Such a technique converts conventional aircraft circuit breakers into a European-style breaker without requiring a full European rebuild and re-qualification. Embodiments can include single and multiple phase versions, and configurations for use with high and low amperage.

20 Claims, 8 Drawing Sheets

INTEGRATED EN-STYLE AUXILIARY BARRIER CONNECTOR

BACKGROUND

The present disclosure relates to circuit breakers including circuit breakers approved for use in aircraft systems.

Circuit breakers are common in electrical applications. Circuit breakers include devices and systems that detect a fault condition in a given electrical circuit, and then open or "break" the circuit when the fault condition is detected. Opening the circuit is typically executed by separating electrical contacts to interrupt the circuit and/or a corresponding flow of electricity. Circuit breakers can be used with high voltage or low voltage electrical systems, and can use a variety of mechanisms for interrupting a circuit. For example, mechanisms can include mechanical, thermal, magnetic, and even manual techniques to open a circuit.

SUMMARY

Various standards, specifications, and regulations exist for particular types of circuit breakers, or for particular uses of circuit breakers. For example, the aircraft industry has many regulations governing aircraft components and systems, and it is common for certain components to be approved prior to general commercial or military use. Approval of aircraft components can take as long as several years to more than a decade. Thus, a new circuit breaker mechanism can take a relatively long time to receive regulatory approval. Because of long approval wait times, it is often preferable to continue using components and devices that have already been approved for use in aircraft. This makes it challenging, however, to use approved circuit breakers for new aircraft systems, such as aircraft systems that differ from conventional specifications, differ by manufacturer or differ by country of origin.

Certain aircraft circuit breakers include a switch mounted on the aircraft circuit breaker. This switch functions as an auxiliary contact signal for monitoring circuit breaker operation. This switch is distinct from a corresponding circuit breaker mechanism, and can be a micro switch or miniature switch. In such an aircraft circuit breaker, power is connected to the terminals. When the circuit breaker is tripped, a lever arm (or other mechanism) that opens the circuit also hits the electrical switch. Actuating the switch can cause a light in a cockpit to turn off (or on) to indicate that power is down for a corresponding circuit.

The U.S. aircraft circuit breaker market conventionally uses male connectors for such micro switches. That is, the micro switch provides male connectors to which a monitoring system can be connected. The European market, however, primarily uses female connectors for these auxiliary switches on aircraft circuit breakers. Such female connectors typically have a spring connector that can lock onto an inserted male connector to help prevent an attached wire from becoming detached. Redesigning aircraft circuit breakers (circuit breaker mechanisms) to accommodate a micro switch that uses female connectors is undesirable because such new circuit breaker designs would require governmental regulatory approval, and getting such approval can take well over a decade to acquire.

Techniques disclosed herein include a conversion technique that converts an aircraft circuit breaker having male auxiliary connectors (micro switch connectors) to an aircraft circuit breaker having female auxiliary connectors, such as those conventionally used on European-made aircraft. Techniques include adding a barrier to a conventional aircraft circuit breaker approved for U.S. markets. This barrier is located relatively close to an existing micro switch and circuit breaker terminals, and includes female auxiliary connectors integrated with the barrier, as well as a flexible circuit (that can include a diode or resistor for current flow) that connects the male connectors with the female connectors such that the female connectors can still receive separate male connectors in the female receptacles. Such a technique converts conventional aircraft circuit breakers into a European-style breaker without requiring a full European rebuild and re-qualification. Embodiments can include single and multiple phase versions, and configurations for use with high and low amperage.

Additionally, although each of the different features, techniques, configurations, etc., herein may be discussed in different places of this disclosure, it is intended that each of the concepts can be executed independently of each other or in combination with each other. Accordingly, the one or more present inventions, embodiments, etc., as described herein can be embodied and viewed in many different ways.

Also, note that this preliminary discussion of embodiments herein does not specify every embodiment and/or incrementally novel aspect of the present disclosure or claimed invention(s). Instead, this brief description only presents general embodiments and corresponding points of novelty over conventional techniques. For additional details and/or possible perspectives (permutations) of the invention(s), the reader is directed to the Detailed Description section and corresponding figures of the present disclosure as further discussed below.

BRIEF DESCRIPTION OF THE DRAWINGS

The foregoing and other objects, features, and advantages of the invention will be apparent from the following more particular description of preferred embodiments herein, as illustrated in the accompanying drawings in which like reference characters refer to the same parts throughout the different views. The drawings are not necessarily to scale, with emphasis instead being placed upon illustrating the embodiments, principles, concepts, etc.

DETAILED DESCRIPTION

Techniques disclosed herein include a conversion technique that converts an aircraft circuit breaker having male auxiliary connectors (micro switch connectors or leads) to an aircraft circuit breaker having female auxiliary connectors, such as those conventionally used on European-made aircraft. Techniques include adding a barrier to a conventional aircraft circuit breaker approved for U.S. markets. This barrier includes female auxiliary connectors integrated with the barrier, as well as a flexible circuit (that can include a diode or resistor for current flow) that connects the male connectors with the female connectors such that the female connectors can still receive separate male connectors in the female receptacles. Such a technique converts conventional aircraft circuit breakers into a European-style breaker without requiring a full European rebuild and re-qualification. Embodiments can include single and multiple phase versions, and configurations for use with high and low amperage.

In general, example embodiments can include a single-phase version, a three-phase version, and a version that handles up to 50 amps or more. The three-phase version can use the same internal mechanisms as the single-phase circuit breaker, but with three mechanisms ganged together. Another version locates a conversion barrier on the outside (instead of positioned between ganged circuit breakers) for applications of 50 amps and above to accommodate separate arc protection barriers that may be larger or designed for a larger wire size and current flow. Conversion techniques adapt certain aircraft circuit breakers without changing the configuration of terminals of the aircraft circuit breakers. Aircraft circuit breakers for up to 50 amps have two barriers with one barrier between each pair of terminals. Techniques can include embedding the female receptacles within one of these barriers. The auxiliary barrier can be molded to accommodate female spring connectors and provide/define the openings for female receptacles.

Figure 1:
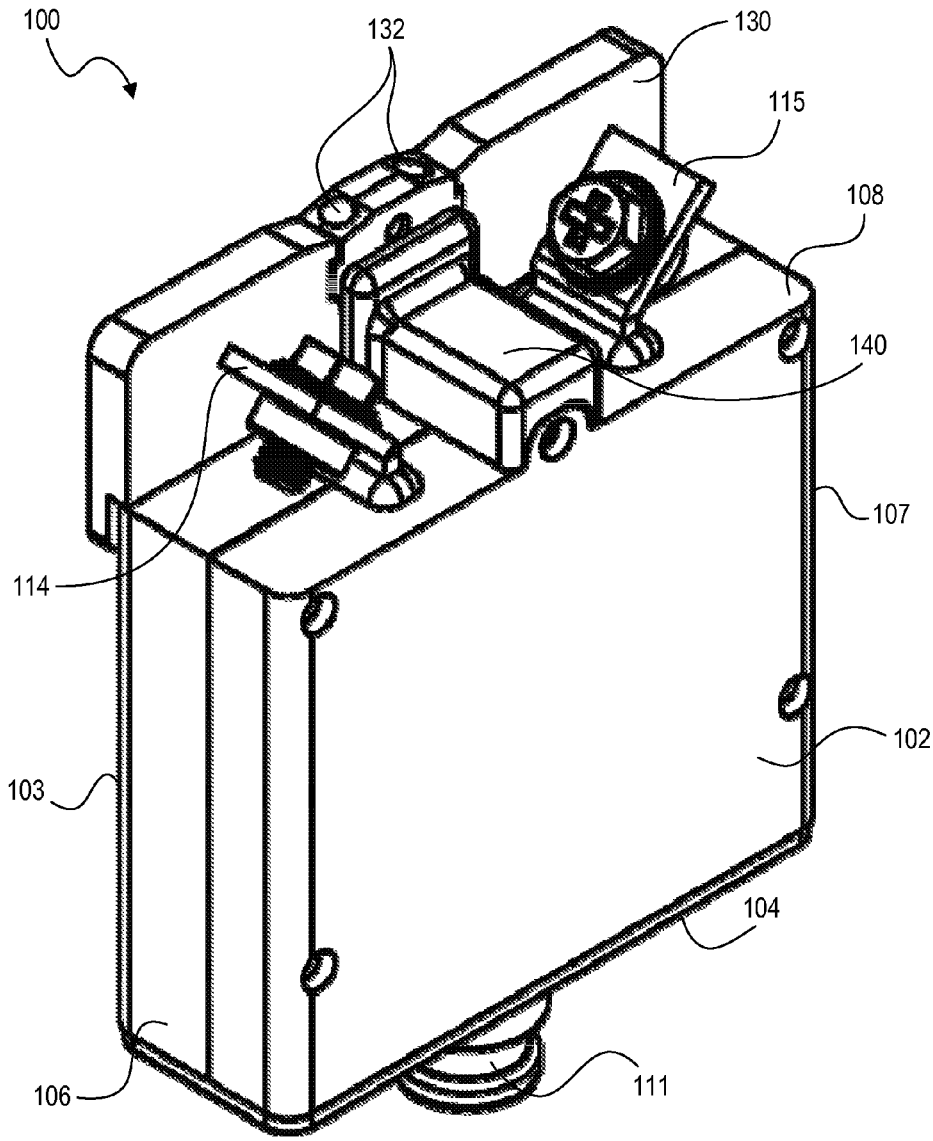
FIG. 1 is a perspective view of an aircraft circuit breaker according to embodiments herein.

Now more specifically, FIG. 1 is a perspective view that illustrates an example embodiment of an aircraft circuit breaker 100. Aircraft circuit breaker 100 includes a housing that and has a front surface 102, a rear surface 103, a bottom surface 104, a first side surface 106, a second side surface 107, and a top surface 108, with each surface being generally rectangular. Accordingly, the aircraft circuit breaker 100 includes a housing that is generally rectangular or box-like is overall shape. Note that this rectangular shape is approximate and that embodiments can have rounded, beveled, or shaped joints. Also note that use of the terms top, bottom, rear, front, etc., is relative and not absolute in that such labels are used to distinguish surfaces relative to each other. For example, reset button 111 is positioned on the bottom surface 104, but in actual installations, this surface may be oriented to appear as a side or top surface.

A first electrical terminal 114 and a second electrical terminal 115 protrude from the top surface 108. These electrical terminals can use a screw connector, spring connector or any other connection mechanism to secure wires from a given circuit to be protected. The electrical terminals provide an electrical path into the aircraft circuit breaker housing. The aircraft circuit breaker 100 includes a circuit breaker mechanism enclosed within the housing. The circuit breaker mechanism electrically connects the first electrical terminal 114 to the second electrical terminal 115, that is, the circuit breaker mechanism provides an electrical path between the electrical terminals. The circuit breaker mechanism is configured to interrupt electrical flow between the first electrical terminal and the second electrical terminal in response to detecting a fault condition. The circuit breaker mechanism can use any conventional interruption mechanism such as a mechanical or spring assembly. Certain embodiments include a circuit breaker mechanism approved by regulatory agencies, such as the Federal Aviation Administration (FAA), a United States government agency.

Figure 2:
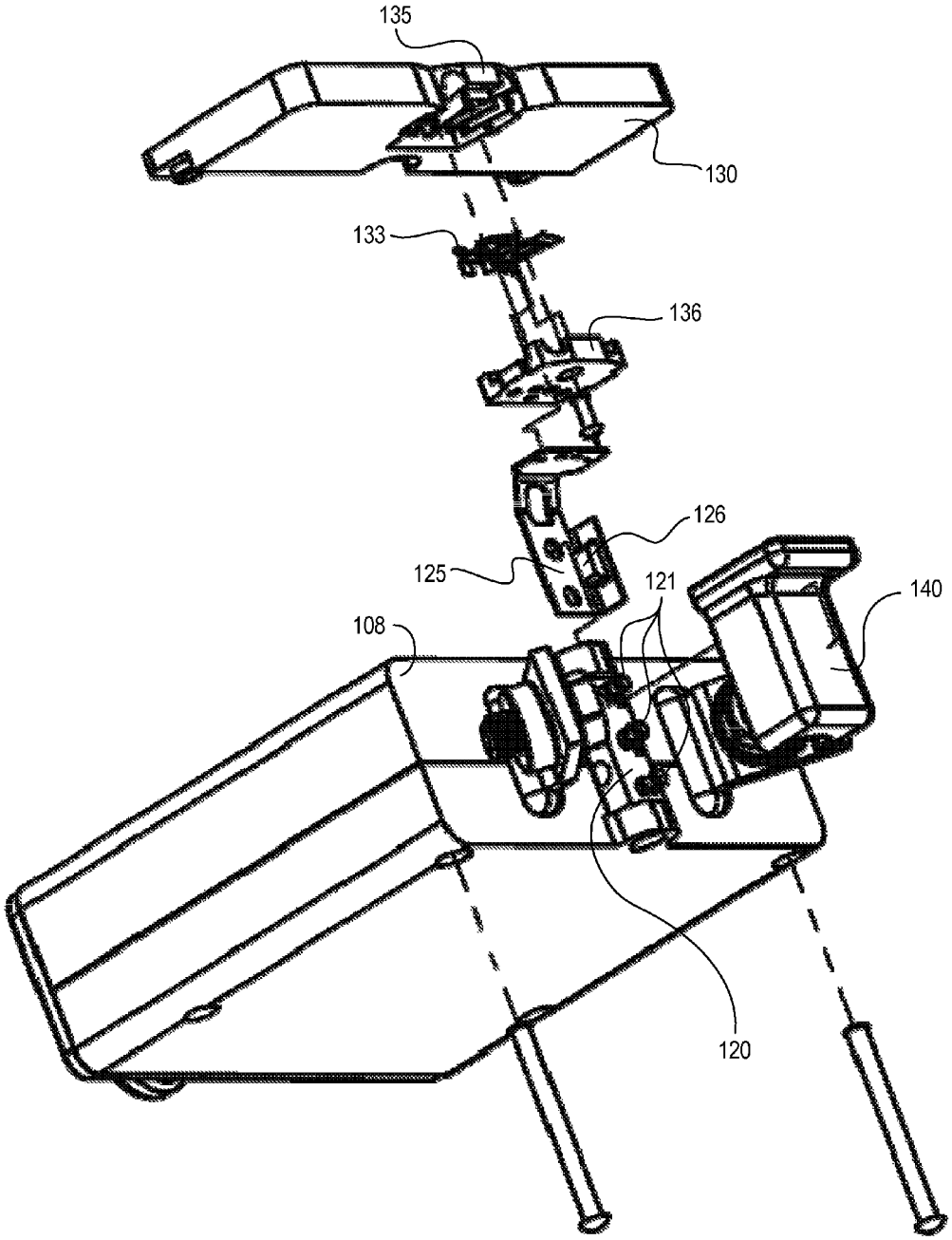
FIG. 2 is an exploded perspective view of an aircraft circuit breaker according to embodiments herein.

Referring now to the exploded view shown in FIG. 2, the aircraft circuit breaker 100 includes an electrical switch 120 located at the top surface 108 of the housing. The electrical switch 120 can protrude from the top surface, be integrated with the top surface, or otherwise be located at the top surface. The electrical switch 120 has male connectors 121 protruding from the electrical switch 120. The electrical switch 120 has a switch mechanism that affects an electrical connection between the male connectors, that is, between a first and second male connector. Affecting this electrical connection means that the switch can either connect or disconnect an electrical path between the two connectors (open or close an electrical path or circuit. The electrical switch 120 is configured such that the switch mechanism is actuated in response to the circuit breaker mechanism interrupting electrical flow between the first electrical terminal 114 and the second electrical terminal 115. Thus, the electrical switch can have components connected to the circuit breaker mechanism within the housing, or have components positioned to be triggered by mechanical action of the circuit breaker mechanism.

The aircraft circuit breaker 100 includes a barrier structure 130 attached to the housing. The barrier structure 130 is generally rectangular and elongated in shape, and has a length approximately equal to a length of the top surface 108. The barrier structure 130 extends from a rear edge of the top surface 108 of the housing and is aligned approximately parallel with the rear surface 103 and perpendicular to the top surface 108. An example of such an orientation is shown in FIGS. 1 and 3C. The barrier structure 130 defines two female electrical connector receptacles 132. Each defined female electrical connector receptacle 132 has a longitudinal axis approximately parallel with the rear surface 103. The defined female electrical connector receptacles 132 have electrical contacts 133 disposed within each defined receptacle. Electrical contacts 133 can be embodied as spring clips that have a tab that can be pressed in by a male mushroom-shaped connector such that after a lip of the male connector passes the spring connector, the spring connector can rebound to lock the male connector in place. The male connector can be subsequently removed with a removal tool.

An electrical switch adaptation mechanism connects the male connectors 121 of the electrical switch 120 with the electrical contacts 133 of the defined female electrical connector receptacles 132 without obstructing the defined female electrical connector receptacles. In other words, the electrical switch adaptation mechanism can electrically couple the male connectors 121 to a side or bottom portion of the electrical contacts 133 of the defined female electrical connector receptacles 132.

In one embodiment, this electrical switch adaptation mechanism includes a flexible circuit 125 that electrically connects the male connectors 121 of the electrical switch 120 with the electrical contacts 133 of the defined female electrical connector receptacles 132. For example, the electrical contacts of the defined female electrical connector receptacles can protrude from a side surface of the barrier structure 130 and connect to the flexible circuit 125. In alternative embodiments, the flexible circuit 125 includes a diode or resistor 126. The electrical switch adaptation mechanism can include a cover 140 that environmentally covers the electrical switch 120, flexible circuit 125, and a portion of the electrical contacts 133 of the defined female electrical connector receptacles 132. The flexible circuit can be constructed as a flexible circuit board that is embedded in between two layers of tape. This flexible circuit board can include wire leads to connect the male connectors to the female connectors. With the flexible circuit 125 being flexible, it can be folded onto itself or otherwise manipulated to fit within the cover 140.

Figure 3A:
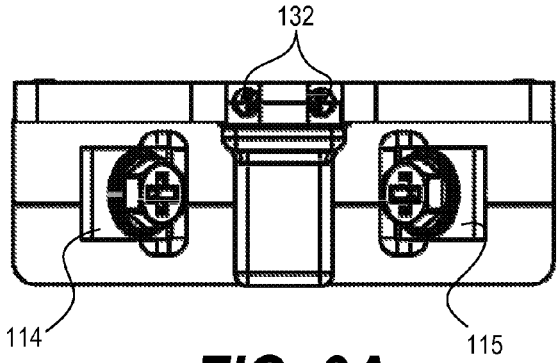
FIG. 3A is a top view of an aircraft circuit breaker according to embodiments herein.
Figure 3B:
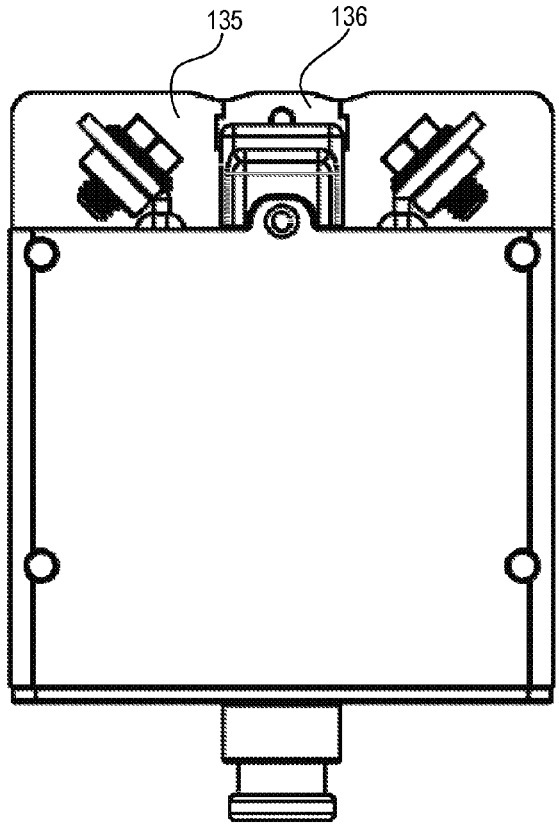
FIG. 3B is a front view of an aircraft circuit breaker according to embodiments herein.
Figure 3C:
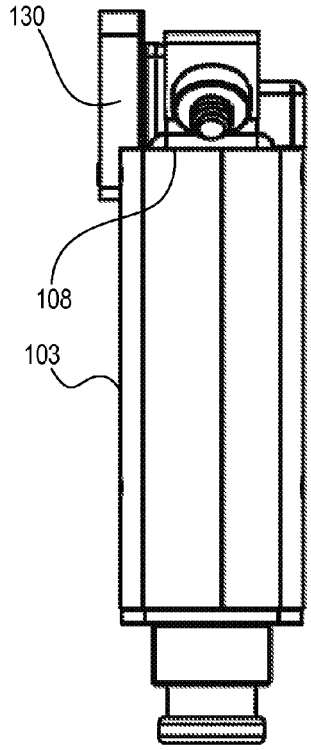
FIG. 3C is a side view of an aircraft circuit breaker according to embodiments herein.

FIGS. 3A, 3B, and 3C show the aircraft circuit breaker 100 of FIG. 1 in top, front and side views respectively. Note that the cover 140 is shown in these views as covering the electrical switch adaptation mechanism.

Figure 4A:
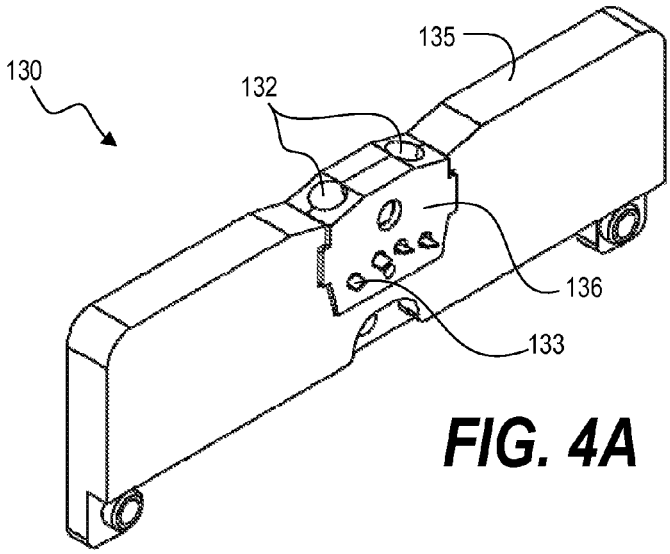
FIG. 4A is a perspective view of an auxiliary barrier connector of an aircraft circuit breaker according to embodiments herein.
Figure 4B:
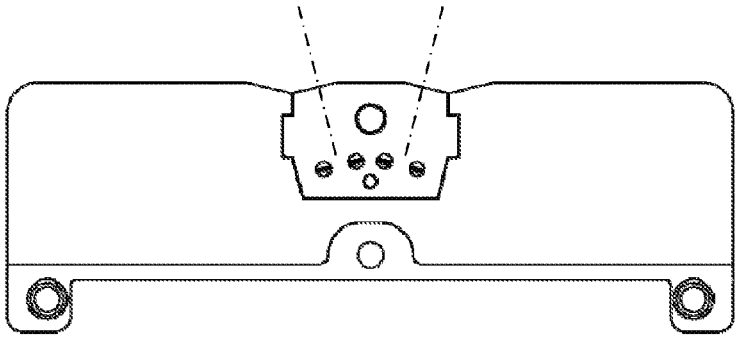
FIG. 4B is a front view of an auxiliary barrier connector of an aircraft circuit breaker according to embodiments herein.
Figure 4C:
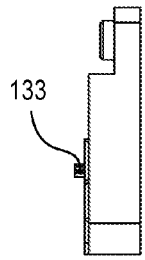
FIG. 4C is a side view of an auxiliary barrier connector of an aircraft circuit breaker according to embodiments herein.
Figure 4D:
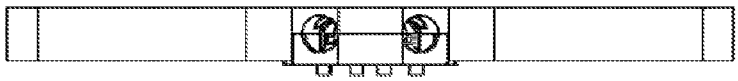
FIG. 4D is a top view of an auxiliary barrier connector of an aircraft circuit breaker according to embodiments herein.

The barrier structure 130 can include a first member 135 that defines a first portion of the defined female electrical connector receptacles, and a second member 136 that defines a remaining portion of the defined female electrical connector receptacles. For example, the first member 135 defines two semi-cylindrical spaces, while the second member 136 defines corresponding semi-cylindrical spaces such that when the second member 136 is combined with the first member 135, the combination defines two approximately cylindrical openings. In some embodiments, the first and second members 135 and 136 can be riveted together. Such connection can hold and position the electrical contacts 133 of the defined female electrical connector receptacles. These electrical contacts 133 can be embodied as contact springs positioned within the defined female electrical connector receptacles 132. The contact springs 133 can have a portion protruding from the second member 136 of the barrier structure 130 and connected to the electrical switch adaptation mechanism. Such protrusion is shown in FIGS. 4A, 4B, and 4C. In other embodiments, the longitudinal axes of the defined female electrical connector receptacles are angled relative to each other resulting in non-parallel longitudinal axes, as shown in FIGS. 4A, 4B, and 4D.

Figure 5:
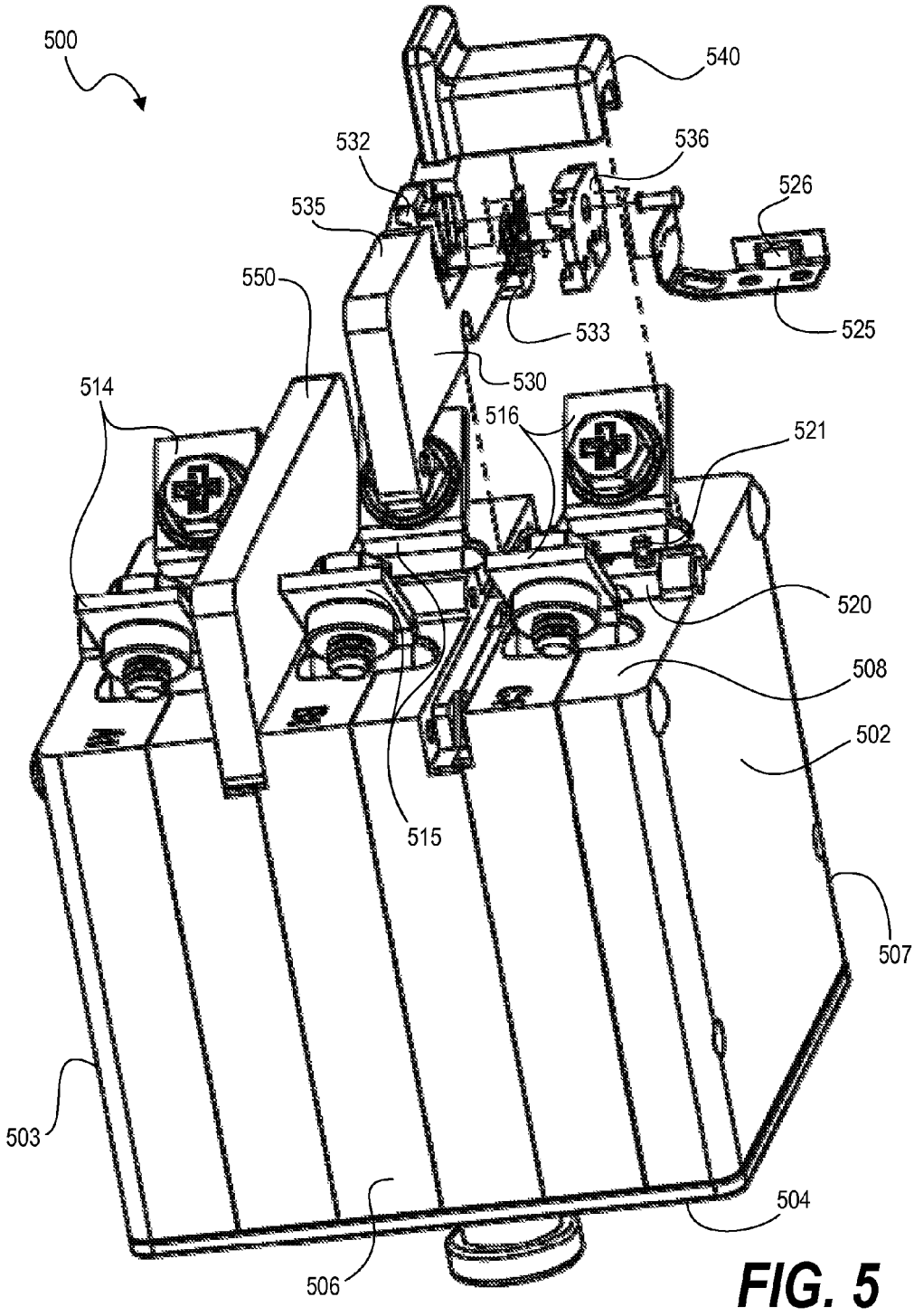
FIG. 5 is an exploded perspective view of an aircraft circuit breaker according to embodiments herein.
Figure 6A:
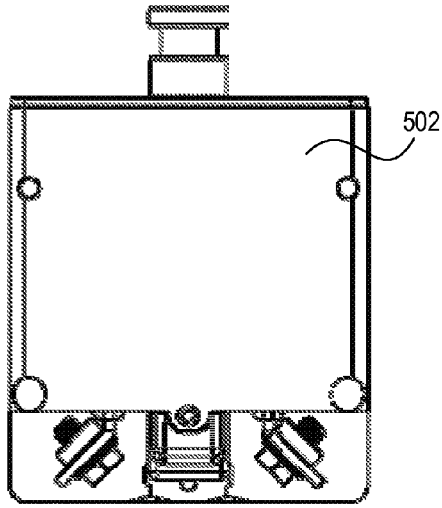
FIG. 6A is a front view of an aircraft circuit breaker according to embodiments herein.
Figure 6B:
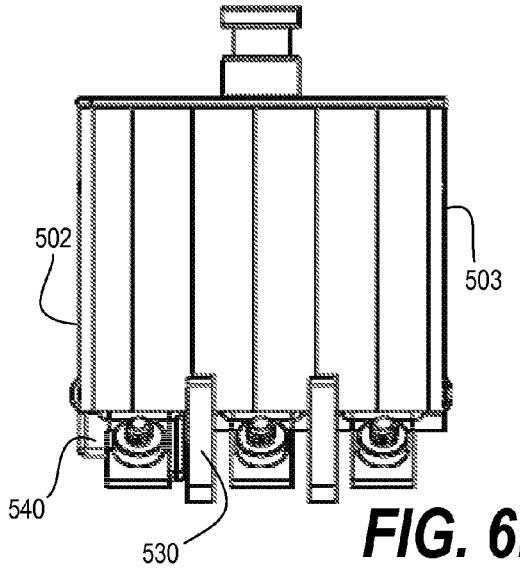
FIG. 6B is a side view of an aircraft circuit breaker according to embodiments herein.
Figure 6C:
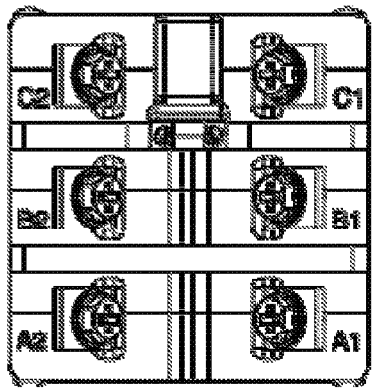
FIG. 6C is a top view of an aircraft circuit breaker according to embodiments herein.
Figure 6D:
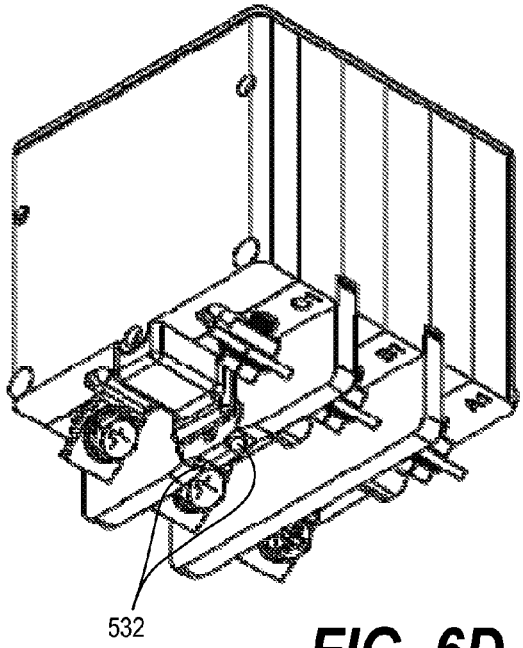
FIG. 6D is a perspective view of an aircraft circuit breaker according to embodiments herein.
Figure 7:
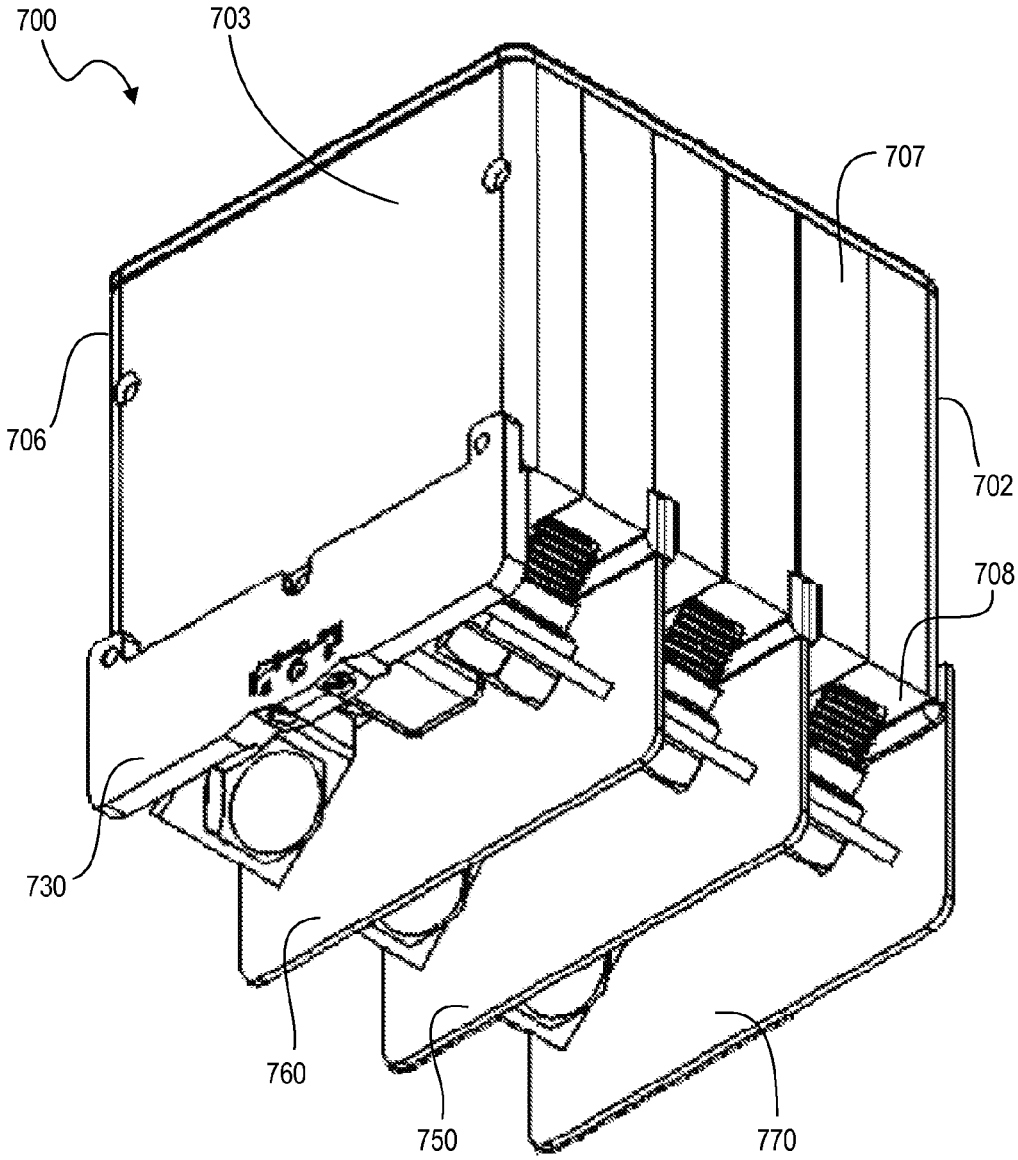
FIG. 7 is an exploded perspective view of an aircraft circuit breaker according to embodiments herein.
Figure 8A:
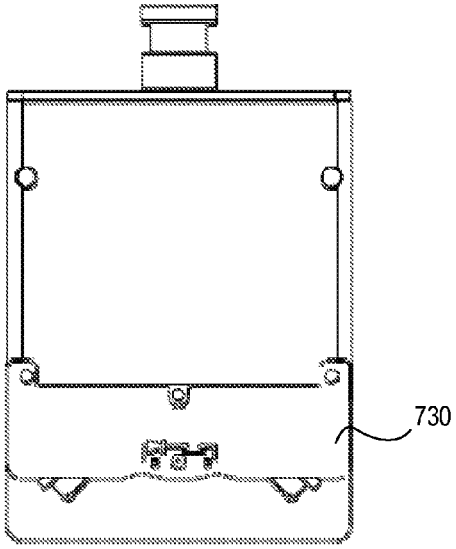
FIG. 8A is a front view of an aircraft circuit breaker according to embodiments herein.
Figure 8B:
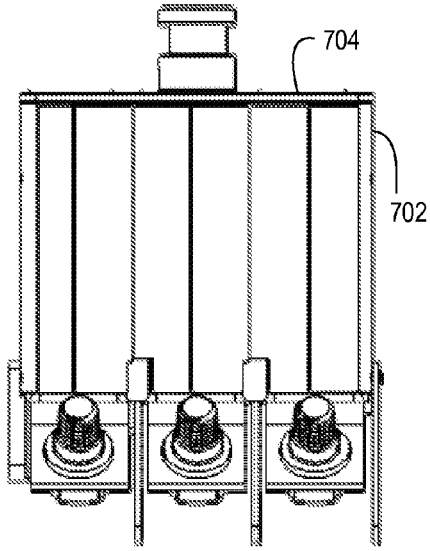
FIG. 8B is a side view of an aircraft circuit breaker according to embodiments herein.
Figure 8C:
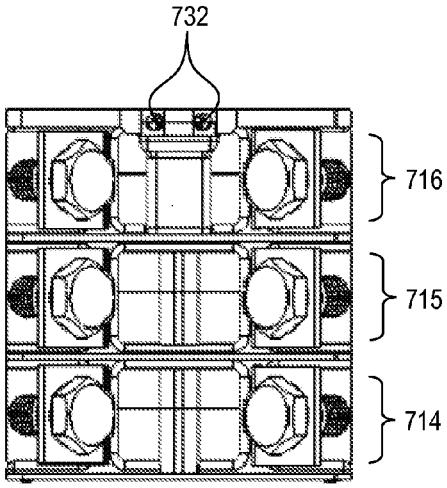
FIG. 8C is a top view of an aircraft circuit breaker according to embodiments herein.

Referring now to FIGS. 5-6, an alternative embodiment is shown illustrating aircraft circuit breaker 500. In general, aircraft circuit breaker 500 can provide a three-phase version of aircraft circuit breaker 100. Aircraft circuit breaker 500 includes a housing that has a front surface 502, a rear surface 503, a bottom surface 504, a first side surface 506, a second side surface 507, and a top surface 508, with each surface being generally rectangular.

The aircraft circuit breaker 500 includes three pairs of electrical terminals 514, 515, and 516 protruding from the top surface 508. The aircraft circuit breaker 500 includes three circuit breaker mechanisms enclosed within the housing. Each circuit breaker mechanism electrically connects one pair of electrical terminals to each other. That is, each circuit breaker mechanism within the housing electrically connects a first terminal of a given pair with a second terminal of that given pair. Each circuit breaker mechanism is configured to interrupt electrical flow between a respective pair of electrical terminals in response to detecting a fault condition. The fault condition can be detected by any of the circuit breaker mechanisms, such that tripping one circuit breaker mechanism causes each circuit to be interrupted.

An electrical switch 520 located at the top surface 508 of the housing is positioned between one pair of the three pairs of electrical terminals. The electrical switch 520 has male connectors 521 protruding from the electrical switch 520. The electrical switch 520 has a switch mechanism that affects an electrical connection between the male connectors. This is a circuit connection distinct from a circuit that the aircraft circuit breaker 500 protects. The electrical switch 520 is configured such that the switch mechanism is actuated in response to one of the circuit breaker mechanisms interrupting electrical flow between a respective pair of electrical terminals.

The aircraft circuit breaker 500 includes a first barrier structure 550 attached to the housing, the first barrier structure 550 being generally rectangular and elongated and having a length approximately equal to a length of the top surface 508. The first barrier structure 550 extends from the top surface of the housing such as to provide a first physical barrier between a first pair of the electrical terminals 514 and a second pair of the electrical terminals 515. A second barrier structure 530 is attached to the housing. The second barrier structure 530 is generally rectangular and elongated and has a length approximately equal to a length of the top surface 508. The second barrier structure 530 extends from (away from) the top surface 508 of the housing such as to provide a second physical barrier between the second pair of the electrical terminals 515 and a third pair of the electrical terminals 516. The second barrier structure 530 defines two female electrical connector receptacles 532. Each defined female electrical connector receptacle has a longitudinal axis approximately parallel with the rear surface 503. The defined female electrical connector receptacles 532 have electrical contacts 533. The aircraft circuit breaker 500 includes an electrical switch adaptation mechanism that connects the male connectors 521 of the electrical switch 520 with the electrical contacts 533 of the defined female electrical connector receptacles 532 without obstructing the defined female electrical connector receptacles.

The electrical switch adaptation mechanism can include a flexible circuit 525 that electrically connects the male connectors of the electrical switch with the electrical contacts of the defined female electrical connector receptacles. This flexible circuit can optionally include a diode or resistor 526. The electrical switch adaptation mechanism can include cover 540 that environmentally covers the electrical switch 520, flexible circuit 525, and at least a portion of the electrical contacts 533 of the defined female electrical connector receptacles. The second barrier structure can include a first member 535 that defines a first portion of the defined female electrical connector receptacles, and a second member 536 that defines a remaining portion of the defined female electrical connector receptacles. The electrical contacts of the defined female electrical connector receptacles can be embodied as contact springs positioned within the defined female electrical connector receptacles. The contact springs can protruding from the second member 536 of the barrier structure and be connected to the electrical switch adaptation mechanism, such as by soldering to the flexible circuit 525. In one embodiment, longitudinal axes of the defined female electrical connector receptacles are angled relative to each other resulting in non-parallel longitudinal axes.

Referring now to FIGS. 7, 8A, 8B, and 8C, an alternative embodiment is shown illustrating aircraft circuit breaker 700.

In general, aircraft circuit breaker 700 can provide a three-phase version of aircraft circuit breaker 100 for higher amperage applications.

Aircraft circuit breaker 700 includes a housing that has a front surface 702, a rear surface 703, a bottom surface 704, a first side surface 706, a second side surface 707, and a top surface 708, with each surface being generally rectangular. Three pairs of electrical terminals (714, 715, 716) protruding from the top surface 708. Three circuit breaker mechanisms enclosed within the housing. Each circuit breaker mechanism electrically connects one pair of electrical terminals to each other. Each circuit breaker mechanism is configured to interrupt electrical flow between a respective pair of electrical terminals in response to detecting a fault condition.

The aircraft circuit breaker 700 includes an electrical switch located at the top surface of the housing and positioned between one pair of the three pairs of electrical terminals. The electrical switch has male connectors protruding from the electrical switch. The electrical switch has a switch mechanism that affects an electrical connection between the male connectors. The electrical switch is configured such that the switch mechanism is actuated in response to one of the circuit breaker mechanisms interrupting electrical flow between a respective pair of electrical terminals.

A first barrier structure 750 is attached to the housing. The first barrier structure 750 is generally rectangular and elongated and has a length approximately equal to a length of the top surface. The first barrier structure 750 extends from the top surface of the housing such as to provide a first physical barrier between a first pair of the electrical terminals 714 and a second pair of the electrical terminals 715. A second barrier structure 760 is attached to the housing. The second barrier structure 760 is generally rectangular and elongated and has a length approximately equal to a length of the top surface. The second barrier structure 760 extends from the top surface 708 of the housing such as to provide a second physical barrier between the second pair of the electrical terminals 715 and a third pair of the electrical terminals 716.

The aircraft circuit breaker 700 includes a third barrier structure 730 attached to the housing. The third barrier structure 730 is generally rectangular and elongated and has a length approximately equal to a length of the top surface. The third barrier structure extends from a rear edge of the top surface of the housing and is aligned approximately parallel with the rear surface 703 and perpendicular to the top surface 708. The third barrier structure defines two female electrical connector receptacles 732. Each defined female electrical connector receptacle 732 has a longitudinal axis approximately parallel with the rear surface. The defined female electrical connector receptacles 732 have electrical contacts. The aircraft circuit breaker 700 includes an electrical switch adaptation mechanism that connects the male connectors of the electrical switch with the electrical contacts of the defined female electrical connector receptacles without obstructing the defined female electrical connector receptacles. The electrical switch adaptation mechanism can include a flexible circuit that electrically connects the male connectors of the electrical switch with the electrical contacts of the defined female electrical connector receptacles, and can optionally include a diode or resistor. The electrical switch adaptation mechanism can includes a cover 740 that environmentally covers the electrical switch, flexible circuit, and a portion of the electrical contacts of the defined female electrical connector receptacles. The third barrier structure can include a first member that defines a first portion of the defined female electrical connector receptacles, and a second member that defines a remaining portion of the defined female electrical connector receptacles. These portions can be riveted or otherwise connected. The electrical contacts of the defined female electrical connector receptacles can be contact springs positioned within the defined female electrical connector receptacles, with the contact springs protruding from the second member of the barrier structure and connected to the electrical switch adaptation mechanism. The aircraft circuit breaker 700 can include a fourth barrier structure 770 to fully protect electrical terminals from each other.

While this invention has been particularly shown and described with references to preferred embodiments thereof, it will be understood by those skilled in the art that various changes in form and details may be made therein without departing from the spirit and scope of the present application as defined by the appended claims. Such variations are intended to be covered by the scope of this present application. As such, the foregoing description of embodiments of the present application is not intended to be limiting. Rather, any limitations to the invention are presented in the following claims.

The invention claimed is:

1. An aircraft circuit breaker comprising:

a housing that and has a front surface, a rear surface, a bottom surface, a first side surface, a second side surface, and a top surface, with each surface being generally rectangular;

a first electrical terminal and a second electrical terminal protruding from the top surface;

a circuit breaker mechanism enclosed within the housing, the circuit breaker mechanism electrically connecting the first electrical terminal to the second electrical terminal, the circuit breaker mechanism configured to interrupt electrical flow between the first electrical terminal and the second electrical terminal in response to detecting a fault condition;

an electrical switch located at the top surface of the housing, the electrical switch having male connectors protruding from the electrical switch, the electrical switch having a switch mechanism that affects an electrical connection between the male connectors, the electrical switch configured such that the switch mechanism is actuated in response to the circuit breaker mechanism interrupting electrical flow between the first electrical terminal and the second electrical terminal;

a barrier structure attached to the housing, the barrier structure being generally rectangular and elongated and having a length approximately equal to a length of the top surface, the barrier structure extending from a rear edge of the top surface of the housing and aligned approximately parallel with the rear surface and perpendicular to the top surface, the barrier structure defining two female electrical connector receptacles, each defined female electrical connector receptacle having a longitudinal axis approximately parallel with the rear surface, the defined female electrical connector receptacles having electrical contacts; and an electrical switch adaptation mechanism that connects the male connectors of the electrical switch with the electrical contacts of the defined female electrical connector receptacles without obstructing the defined female electrical connector receptacles.

2. The aircraft circuit breaker of claim 1, wherein the electrical switch adaptation mechanism includes a flexible circuit that electrically connects the male connectors of the electrical switch with the electrical contacts of the defined female electrical connector receptacles.

3. The aircraft circuit breaker of claim 2, wherein the flexible circuit includes a diode.

4. The aircraft circuit breaker of claim 2, wherein the electrical switch adaptation mechanism includes a cover that environmentally covers the electrical switch, flexible circuit, and a portion of the electrical contacts of the defined female electrical connector receptacles.

5. The aircraft circuit breaker of claim 1, wherein the barrier structure includes a first member that defines a first portion of the defined female electrical connector receptacles, and a second member that defines a remaining portion of the defined female electrical connector receptacles.

6. The aircraft circuit breaker of claim 5, wherein the electrical contacts of the defined female electrical connector receptacles are contact springs positioned within the defined female electrical connector receptacles, the contact springs protruding from the second member of the barrier structure and connected to the electrical switch adaptation mechanism.

7. The aircraft circuit breaker of claim 1, wherein the a longitudinal axes of the defined female electrical connector receptacles are angled relative to each other resulting in non-parallel longitudinal axes.

8. An aircraft circuit breaker comprising:

a housing that and has a front surface, a rear surface, a bottom surface, a first side surface, a second side surface, and a top surface, with each surface being generally rectangular;

three pairs of electrical terminals protruding from the top surface;

three circuit breaker mechanisms enclosed within the housing, each circuit breaker mechanism electrically connecting one pair of electrical terminals to each other, each circuit breaker mechanism configured to interrupt electrical flow between a respective pair of electrical terminals in response to detecting a fault condition;

an electrical switch located at the top surface of the housing and positioned between one pair of the three pairs of electrical terminals, the electrical switch having male connectors protruding from the electrical switch, the electrical switch having a switch mechanism that affects an electrical connection between the male connectors, the electrical switch configured such that the switch mechanism is actuated in response to one of the circuit breaker mechanisms interrupting electrical flow between a respective pair of electrical terminals;

a first barrier structure attached to the housing, the first barrier structure being generally rectangular and elongated and having a length approximately equal to a length of the top surface, the first barrier structure extending from the top surface of the housing such as to provide a first physical barrier between a first pair of the electrical terminals and a second pair of the electrical terminals;

a second barrier structure attached to the housing, the second barrier structure being generally rectangular and elongated and having a length approximately equal to a length of the top surface, the second barrier structure extending from the top surface of the housing such as to provide a second physical barrier between the second pair of the electrical terminals and a third pair of the electrical terminals, the second barrier structure defining two female electrical connector receptacles, each defined female electrical connector receptacle having a longitudinal axis approximately parallel with the rear surface, the defined female electrical connector receptacles having electrical contacts; and an electrical switch adaptation mechanism that connects the male connectors of the electrical switch with the electrical contacts of the defined female electrical connector receptacles without obstructing the defined female electrical connector receptacles.

9. The aircraft circuit breaker of claim 8, wherein the electrical switch adaptation mechanism includes a flexible circuit that electrically connects the male connectors of the electrical switch with the electrical contacts of the defined female electrical connector receptacles.

10. The aircraft circuit breaker of claim 9, wherein the flexible circuit includes a resistor.

11. The aircraft circuit breaker of claim 9, wherein the electrical switch adaptation mechanism includes a cover that environmentally covers the electrical switch, flexible circuit, and a portion of the electrical contacts of the defined female electrical connector receptacles.

12. The aircraft circuit breaker of claim 8, wherein the second barrier structure includes a first member that defines a first portion of the defined female electrical connector receptacles, and a second member that defines a remaining portion of the defined female electrical connector receptacles.

13. The aircraft circuit breaker of claim 12, wherein the electrical contacts of the defined female electrical connector receptacles are contact springs positioned within the defined female electrical connector receptacles, the contact springs protruding from the second member of the barrier structure and being connected to the electrical switch adaptation mechanism.

14. The aircraft circuit breaker of claim 8, wherein longitudinal axes of the defined female electrical connector receptacles are angled relative to each other resulting in non-parallel longitudinal axes.

15. An aircraft circuit breaker comprising:

a housing that has a front surface, a rear surface, a bottom surface, a first side surface, a second side surface, and a top surface, with each surface being generally rectangular;

three pairs of electrical terminals protruding from the top surface;

three circuit breaker mechanisms enclosed within the housing, each circuit breaker mechanism electrically connecting one pair of electrical terminals to each other, each circuit breaker mechanism configured to interrupt electrical flow between a respective pair of electrical terminals in response to detecting a fault condition;

an electrical switch located at the top surface of the housing and positioned between one pair of the three pairs of electrical terminals, the electrical switch having male connectors protruding from the electrical switch, the electrical switch having a switch mechanism that affects an electrical connection between the male connectors, the electrical switch configured such that the switch mechanism is actuated in response to one of the circuit breaker mechanisms interrupting electrical flow between a respective pair of electrical terminals;

a first barrier structure attached to the housing, the first barrier structure being generally rectangular and elongated and having a length approximately equal to a length of the top surface, the first barrier structure extending from the top surface of the housing such as to provide a first physical barrier between a first pair of the electrical terminals and a second pair of the electrical terminals;

a second barrier structure attached to the housing, the second barrier structure being generally rectangular and elongated and having a length approximately equal to a length of the top surface, the second barrier structure extending from the top surface of the housing such as to provide a second physical barrier between the second pair of the electrical terminals and a third pair of the electrical terminals;

a third barrier structure attached to the housing, the third barrier structure being generally rectangular and elongated and having a length approximately equal to a length of the top surface, the third barrier structure extending from a rear edge of the top surface of the housing and aligned approximately parallel with the rear surface and perpendicular to the top surface, the third barrier structure defining two female electrical connector receptacles, each defined female electrical connector receptacle having a longitudinal axis approximately parallel with the rear surface, the defined female electrical connector receptacles having electrical contacts; and an electrical switch adaptation mechanism that connects the male connectors of the electrical switch with the electrical contacts of the defined female electrical connector receptacles without obstructing the defined female electrical connector receptacles.

16. The aircraft circuit breaker of claim 15, wherein the electrical switch adaptation mechanism includes a flexible circuit that electrically connects the male connectors of the electrical switch with the electrical contacts of the defined female electrical connector receptacles.

17. The aircraft circuit breaker of claim 16, wherein the flexible circuit includes a diode.

18. The aircraft circuit breaker of claim 16, wherein the electrical switch adaptation mechanism includes a cover that environmentally covers the electrical switch, flexible circuit, and a portion of the electrical contacts of the defined female electrical connector receptacles.

19. The aircraft circuit breaker of claim 15, wherein the third barrier structure includes a first member that defines a first portion of the defined female electrical connector receptacles, and a second member that defines a remaining portion of the defined female electrical connector receptacles.

20. The aircraft circuit breaker of claim 19, wherein the electrical contacts of the defined female electrical connector receptacles are contact springs positioned within the defined female electrical connector receptacles, the contact springs protruding from the second member of the barrier structure and connected to the electrical switch adaptation mechanism.

* * * * *